US009303439B2

(12) United States Patent
Kreitzer

(10) Patent No.: US 9,303,439 B2
(45) Date of Patent: Apr. 5, 2016

(54) AUTOMATIC LOCKING APPARATUS

(71) Applicant: Joseph Daniel Kreitzer, Knoxville, TN (US)

(72) Inventor: Joseph Daniel Kreitzer, Knoxville, TN (US)

( * ) Notice: Subject to any disclaimer, the term of this patent is extended or adjusted under 35 U.S.C. 154(b) by 35 days.

(21) Appl. No.: 14/253,765

(22) Filed: Apr. 15, 2014

(65) Prior Publication Data

US 2014/0306465 A1 Oct. 16, 2014

Related U.S. Application Data

(60) Provisional application No. 61/812,210, filed on Apr. 15, 2013.

(51) Int. Cl.

| | |
|---|---|
| ***E05C 3/02*** | (2006.01) |
| ***E05F 1/00*** | (2006.01) |
| ***B65F 1/14*** | (2006.01) |
| ***E05B 15/00*** | (2006.01) |
| *E05C 3/00* | (2006.01) |

(52) U.S. Cl.

CPC ..... *E05F 1/002* (2013.01); *B65F 1/1615* (2013.01); *E05B 15/0093* (2013.01); *Y10T 292/45* (2015.04)

(58) Field of Classification Search

CPC ..... B65F 1/1615; E05F 1/002; E05B 15/0093
USPC ..... 292/230, 231, 238, 259 R, 305; 220/315, 823, 827, 830, 908
See application file for complete search history.

(56) References Cited

U.S. PATENT DOCUMENTS

| | | | | | |
|---|---|---|---|---|---|
| 2,474,934 | A | * | 7/1949 | Domagall | 220/88.1 |
| 2,557,048 | A | * | 6/1951 | Haase | 220/830 |
| 3,651,786 | A | * | 3/1972 | Patterson et al. | 119/481 |
| 4,182,530 | A | * | 1/1980 | Hodge | 294/68.26 |
| 4,199,075 | A | * | 4/1980 | Rohrer | 220/827 |
| 5,094,358 | A | * | 3/1992 | Serio, Sr. | 220/315 |
| 5,118,000 | A | * | 6/1992 | Howell et al. | 220/315 |
| 5,213,382 | A | * | 5/1993 | Dawdy et al. | 292/228 |
| 5,224,743 | A | * | 7/1993 | Dawdy et al. | 292/228 |
| 5,240,319 | A | * | 8/1993 | Koga | 312/319.2 |
| 5,415,314 | A | * | 5/1995 | McCollum | 220/315 |
| 5,419,598 | A | * | 5/1995 | Kreitzer | 292/230 |
| 5,474,341 | A | * | 12/1995 | Putman et al. | 292/230 |
| 5,490,606 | A | * | 2/1996 | Lombardo | 220/324 |
| 5,599,050 | A | * | 2/1997 | Tinsley | 292/230 |
| 5,683,126 | A | * | 11/1997 | De Vivo et al. | 292/230 |
| 6,733,053 | B2 | * | 5/2004 | Hodge et al. | 292/336.3 |
| 7,597,365 | B2 | * | 10/2009 | Kreitzer | 292/148 |
| 7,810,854 | B2 | * | 10/2010 | Hodge et al. | 292/259 R |
| 8,313,126 | B2 | * | 11/2012 | Ferkovich et al. | 292/230 |

FOREIGN PATENT DOCUMENTS

| | | | | |
|---|---|---|---|---|
| DE | 29500223 | * | 3/1995 | |
| FR | 2562516 | A1 * | 10/1985 | B65F 1/16 |

* cited by examiner

*Primary Examiner* — Carlos Lugo

(57) ABSTRACT

An automatic locking apparatus mounted to a trash bin is provided. The automatic locking apparatus may also include a pair of lock bar arms and a lock bar that pivots from an unreleased position to a released position. The automatic locking apparatus may include a pivot bar, a biasing mechanism and a pivot rod. The pivot rod may rotate from a locked position to an unlocked position. The pair of lock bar arms may be perpendicularly joined to the pivot bar. The biasing mechanism may be disposed about the pivot bar so as to engage an upper tab provided by the bar pivot rod, when the bar pivot rod is in the locked position. When the pair of lock bar arms rotate to the released position, torque may be transmitted through the pivot bar to the biasing mechanism so as to urge the lock bar arms back to the unreleased position. When the pivot rod may be in the unlocked position the upper tab may be disengaged from the biasing mechanism so as to bypass biasing mechanism, when moving the pivot bar to the released position.

10 Claims, 4 Drawing Sheets

AUTOMATIC LOCKING APPARATUS

CROSS-REFERENCE TO RELATED APPLICATION

This application claims the benefit of priority of U.S. provisional application No. 61/812,210, filed 15 Apr. 2013, the contents of which are herein incorporated by reference.

BACKGROUND OF THE INVENTION

The present invention relates to automatic locking apparatuses and, more particularly, to a lock mechanism for trash bins that is automatically biased to an unreleased position from a released position.

Private trash bins having hinged lids are a common fixture on many commercial properties. The costs associated with a trash bin may be increased by unauthorized usage, since unauthorized usage increases the frequency with which the trash bin must be dumped. Furthermore, unauthorized usage of a trash bin dedicated to one form of recyclable material may result in contamination of the recyclable material.

Nonetheless, the trash bin must be accessible by a trash collector when the time does come to dump it. In particular, a locking mechanism should automatically release when the trash bin is inverted to be dumped, typically by a front-loading garbage truck with lifting arms, so that the trash collector is not required to leave the garbage truck prior to dumping the bin. The locking mechanism typically includes a locking bar assembly pivotally attached to the trash bin and movable between an unreleased locked position preventing opening of the trash bin lid and a released position in which it is rotated out of the way of the lid.

Currently, after dumping when the trash collector lowers down the trash bin, the locking bar assembly is still either in the released position or not fully returned to the unreleased position, because the locking mechanism is not adapted to automatically urge the locking bar assembly back to the unreleased position. As a result, the trash collector is still required to bounce the locking bar assembly to the unreleased position by use of the truck lifting arms. This damages the trash bin lifting pockets and shortens the life of the locking bar assembly.

As can be seen, there is a need for a trash bin locking system that automatically urges the locking bar assembly back to the unreleased position from the released position.

SUMMARY OF THE INVENTION

In one aspect of the present invention, an apparatus for automatically restraining at least one lid of a trash bin comprises: a frame comprising a biasing side and a lock side, wherein the frame is coupled to a wall of the trash bin; a pivot bar supported by the frame for rotating between an unreleased position and a released position, wherein the pivot bar is cantilevered to at least one lock bar assembly for restraining the at least one lid of the trash bin from moving from a closed position to an open position, wherein the pivot bar protrudes through the biasing side; a lower tab joined to the pivot bar near the biasing side; an upper tab joined to the biasing side; and a biasing mechanism disposed about the pivot bar between the lower tab and the biasing side, wherein the biasing mechanism terminates in a first moment arm and an opposing second moment arm, wherein the first moment arm is engaged by the lower tab, and wherein the second moment arm engages the upper tab, whereby transmitting torque to and from the biasing mechanism from and to the pivot bar.

In another aspect of the present invention, apparatus for automatically restraining at least one lid of a trash bin comprises: a frame comprising a biasing side and a lock side, wherein the frame is coupled to a wall of the trash bin, wherein the lock side provides a first padlock flange; a pivot bar journaled through the frame for rotating between an unreleased position and a released position, wherein the pivot bar is cantilevered to at least one lock bar assembly for restraining the at least one lid of the trash bin from moving from a closed position to an open position, wherein the pivot bar protrudes through the biasing side terminating near a provided lower tab; a pivot rod journaled through the frame for rotating between a locked position and an unlocked position, wherein the pivot rod protrudes through the biasing side terminating in an upper tab, and the pivot rod protrudes through the lock side terminating in a second padlock flange operatively associated with the first padlock flange; and a biasing mechanism disposed about the pivot bar between the lower tab and the biasing side, wherein the biasing mechanism terminates in a first moment arm and an opposing second moment arm, wherein the first moment arm is engaged by the lower tab, and wherein the second moment arm engages the upper tab, wherein torque is transmitted to and from the biasing mechanism from and to the pivot bar, wherein the first padlock flange and the second padlock flange each define a lock hole disposed to be aligned when the pivot rod is in the locked position, and wherein the frame comprises a housing enclosing at least a portion of moving parts of a locking mechanism, wherein the housing is sandwiched between the biasing side and the lock side.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an automatic locking apparatus mounted to a trash bin. The automatic locking apparatus may also include a pair of lock bar arms and a lock bar that pivots from an unreleased position to a released position. The automatic locking apparatus may include a pivot bar, a biasing mechanism and a pivot rod. The pivot rod may rotate from a locked position to an unlocked position. The pair of lock bar arms may be perpendicularly joined to the pivot bar. The biasing mechanism may be disposed about the pivot bar so as to engage an upper tab provided by the bar pivot rod, when the bar pivot rod is in the locked position. When the pair of lock bar arms rotate to the released position, torque may be transmitted through the pivot bar to the biasing mechanism so as to urge the lock bar arms back to the unreleased position. When the pivot rod may be in the unlocked position the upper tab may be disengaged from the biasing mechanism so as to bypass biasing mechanism, when moving the pivot bar to the released position.

Figure 1:
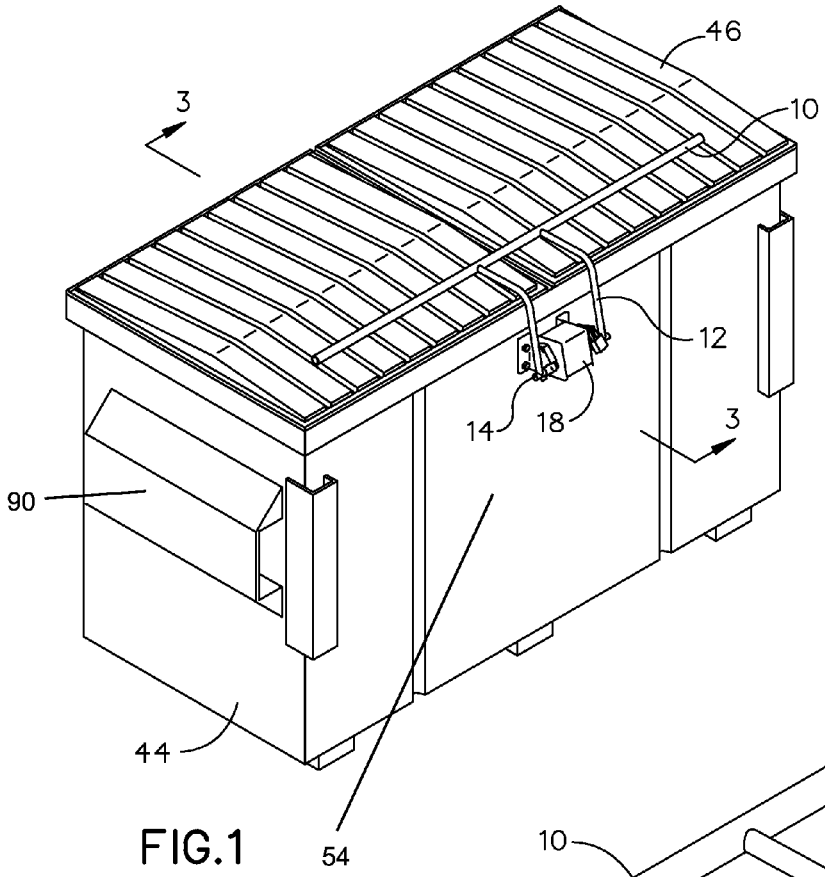
FIG. 1 is a perspective view of an exemplary embodiment of the present invention, shown in use.
Figure 2:
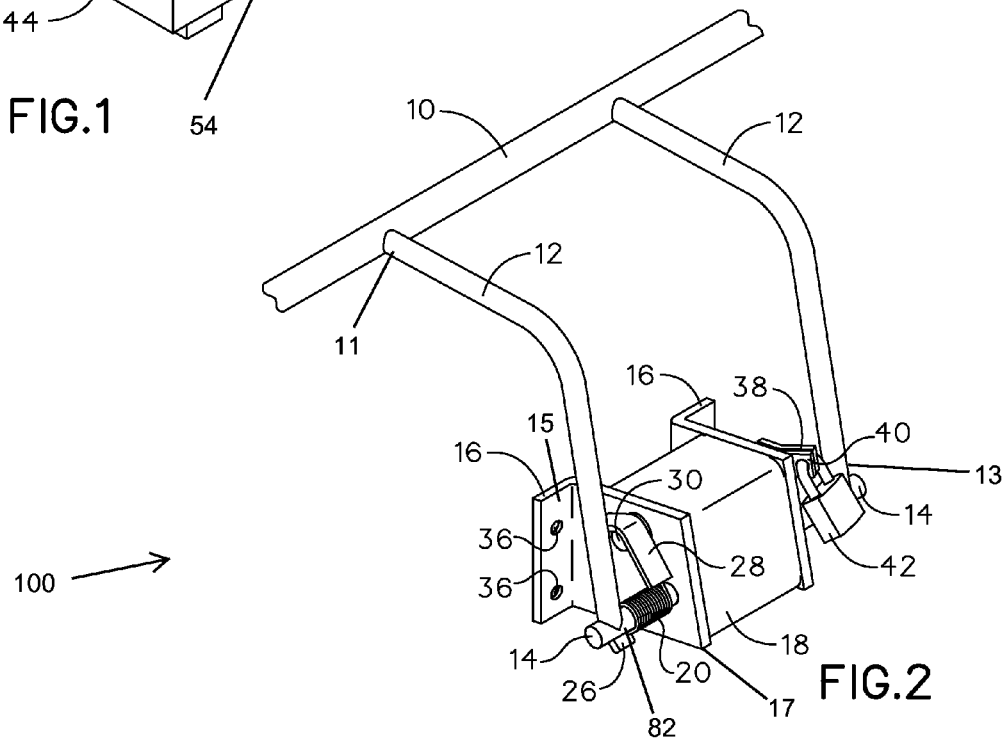
FIG. 2 is a perspective view of an exemplary embodiment of the present invention.
Figure 3:
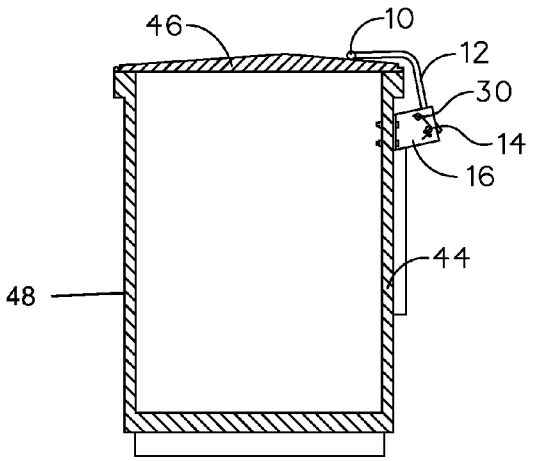
FIG. 3 is a section detail view of an exemplary embodiment of the present invention, taken along line 3-3 in FIG. 1.
Figure 4:
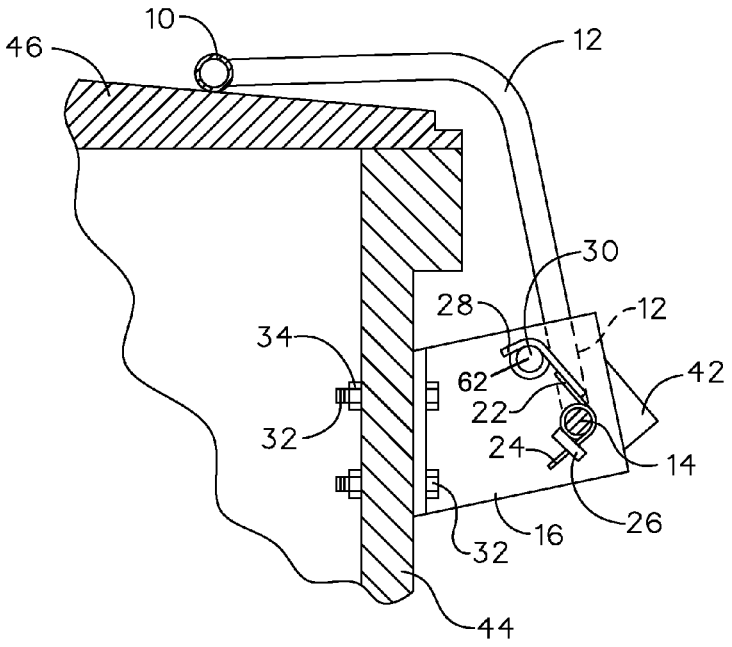
FIG. 4 is a detail section view of an exemplary embodiment of the present invention, in the unreleased.

Referring to FIGS. 1 through 9, the present invention may include an automatic locking apparatus 100 mounted to a front-loaded trash bin 44. The trash bin 44 may include any container which can be emptied by inversion. The trash bin 44 may include a box-like body 48 accessible through an upper opening defined by a flange along a front wall 54 of the box-like body 48. At least one trash lid 46 may be pivotably connected to the body 48 so as to pivotably move to and from an open position and a closed position. As illustrated in FIGS. 1 and 2, a plurality of lift sleeves 90 may be fixed to the side walls of the body 48.

The automatic locking apparatus 100 may include a lock bar 10, a pair of lock bar arms 12, a pivot bar 14, a pair of brackets 16, a housing 18, a biasing mechanism 20 and a pivot rod 30.

Each lock bar arm 12 may be bent metal tubular rods having a lock bar end 11 and a pivot bar end 13. The plurality of lock bar ends 11 may be perpendicularly joined to the lid-restraining lock bar 10. The plurality of pivot bar ends 13 may be coupled in a conventional manner near the ends of the pivot bar 14 so as to pivot about an axis 70 parallel to the plane of the front wall 54 of the trash bin 44. The pair of lock bar arms and the lock bar 10 may comprise a lock bar assembly.

Figure 5:
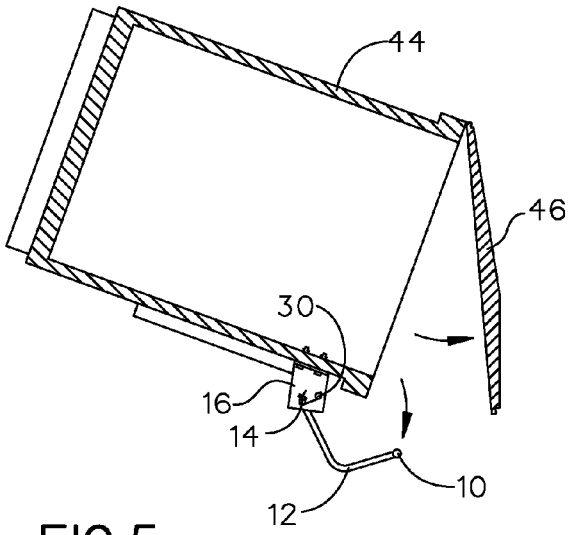
FIG. 5 is a section view of an exemplary embodiment of the present invention, in the released position.
Figure 7:
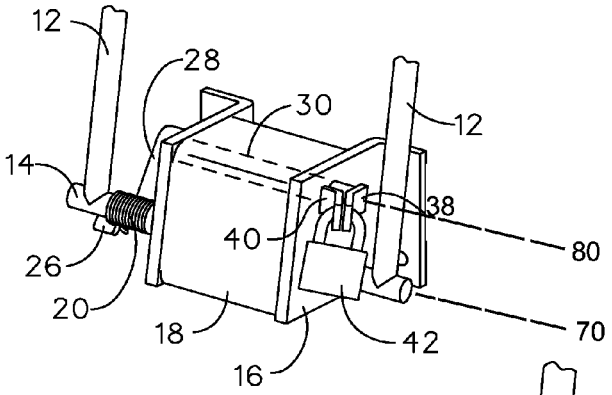
FIG. 7 is a reverse perspective view of an exemplary embodiment of the present invention, in the locked position.
Figure 8:
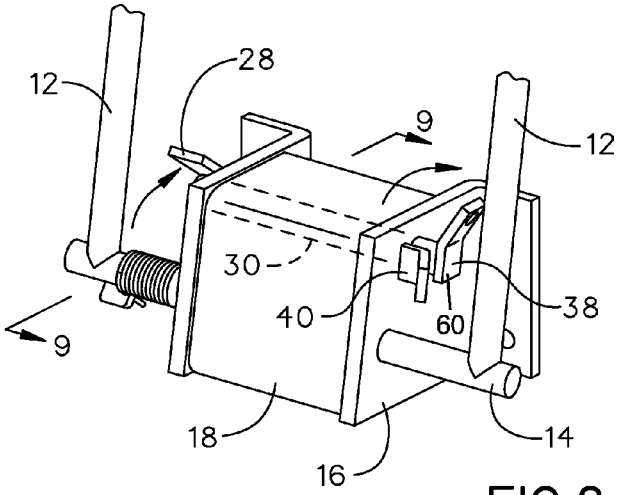
FIG. 8 is a reverse perspective view of an exemplary embodiment of the present invention, in the unlocked position.

As best illustrated in FIGS. 2, 7 and 8, the plurality of lock bar arms 12 may be cantilevered on the pivot bar 14 to permit pivotal movement of the pair of lock bar arms 12 about the axis 70 between an unreleased position (FIG. 3) and a released position (FIG. 5). In the unreleased position, the lid-restraining lock bar 10 overlies the at least one lid 46 to prevent the at least one lid 46 from pivoting out of the closed position. In the released position, the lock bar 10 may be pivoted away from the at least one lid 46 thereby permitting the at least one lid 46 to pivot to the open position to permit trash to be deposited in the interior of the trash bin 44.

As illustrated in FIG. 1 the lid-restraining lock bar 10 of the plurality of lock bar arms 12 do not actually contact the at least one trash lid 46 while they are lying in their unreleased position. Rather, the lock bar 10 may overhang the at least one trash lid 46 and prevent the at least one trash lid 46 from being opened widely enough to deposit trash.

A pair of lifting sleeves 90 may be mounted on side walls of the body 48. These lifting sleeves 90 may be engaged by forks (not shown) of a lifting mechanism (not shown) of a trash collection truck (not shown) in order to lift the trash bin 44 and dump its contents into a suitable receptacle (not shown) in the trash collection truck.

The housing 18 may at least partially enclose moving parts of a locking mechanism, which under the force of gravity, during the dumping of the trash bin 44, releases the lock bar arms 12 to pivot under their own weight toward their released position, as illustrated in FIG. 5. The housing 18 may inhibit tampering with the locking mechanism and protects the locking mechanism against exposure to the trash placed in the trash bin 44.

Each side of the housing 18 may be fixed to one of the pair of brackets 16. Each bracket 16 may have a first leg 15 and a second leg 17. Each first leg 15 may define a plurality of attachment holes 36. Each first leg 15 may be coupled to the front wall 54 by means of a plurality of nuts 34 and bolts 32. Each second leg 17 may be perpendicularly joined to each opposing side of the housing 18. Each second leg 17 may define a bar hole and a pivot bar hole that may be in alignment on opposing sides of the housing 18. One second leg 17 may include a first padlock flange 40 near the bar hole. The first padlock flange 40 may define a hole. The first padlock flange 40 may be joined to the one second leg 17 by any convention means, such as but not limited to welding.

The pivot rod 30 may include a padlock end 60 and a biasing end 62. The biasing end 62 may terminate in an upper tab 28. The upper tab 28 may be joined to the pivot rod 30 by convention means, such as but not limited to welding. The pivot rod 30 may be journaled in the pivot bar holes of the two opposing side plates 17 for rotational movement about an axis 80. The padlock end 60 may terminate in a second padlock flange 38. The second padlock flange 38 may be joined to the pivot rod 30 by any convention means, such as but not limited to welding. The second padlock flange 38 may define a hole. The pivot rod 30 may be rotated to a locked position, wherein the holes in the first padlock flange 40 and the second padlock flange 38 align.

A shackle of a padlock 42 may extend through the aligned holes in the first padlock flange 40 and the second padlock flange 38. The shackle may restrain the pivot bar 14 from rotating from locked position to an unlocked position. The padlock 42 may be a key-actuated lock or a combination look. Alternatively, a fastener (not shown) may be used as a shackle to couple the first padlock flange 40 and the second padlock flange 38. In certain embodiments, the unlocked position disengages the locking mechanism enclosed with in the housing 18.

Figure 6:
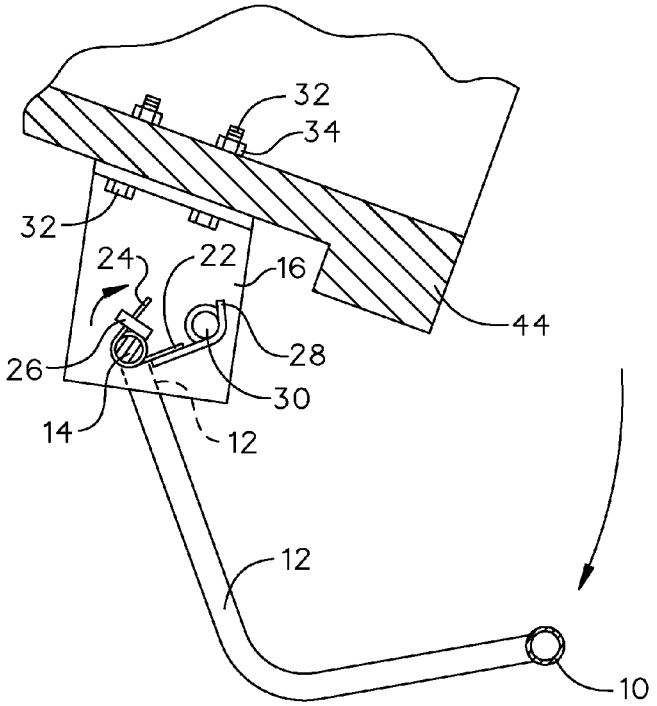
FIG. 6 is a section detail view of an exemplary embodiment of the present invention, in released position.

The pivot bar 14 may include a biasing side 82 and a padlock side. The pivot bar 14 may be journaled in the bar holes of the two opposing side plates 17. On the biasing side 82, the pivot bar 14 may form a lower tab 26. The biasing mechanism 20 may be disposed about the pivot bar 14 between one lock bar arm 12 and the housing 18 on the biasing side 82. The biasing mechanism 20 may include any elastic object used to store mechanical energy, such as but not limited to a torsion spring or the like. The biasing mechanism 20 may store a torque and/or a twisting force load. The biasing mechanism 20 may include an upper moment arm 22 and a lower moment arm 24. The lower tab 26 may be adapted to apply torque to the lower moment arm 24. The lower tab 26 may be joined to the pivot rod 14 by convention means, such as but not limited to welding. In certain embodiments, the lower tab 26 may be adapted to transmit rotational mechanical energy and/or torque of the pivot bar 14 to/from the lower moment arm 24. In certain embodiments, the lower tab 26 may define a hole adapted to receive and/or otherwise engage the lower moment arm 24. The upper tab 28 may be adapted to engage the upper moment arm 22 so as to facilitate the transmission of rotational energy and/or torque to/from the biasing mechanism 20 from/to the pivot bar 14 when the pivot bar 14 may be rotating to the released position In the locked position, the upper moment arm 22 may be engaged by the upper tab 28 so that when the pivot bar 14 rotates about its axis 70 toward the released position the resulting rotational force and/or torque may be transmitted to the biasing mechanism 20 so as to bias the pivot bar 14 to the unreleased position, as illustrated in FIG. 6. As a result, when the collection truck has un-inverted and lowered down the trash bin 44, the pivot bar 14 may be urged to automatically rotate the lock bar arms 12 back to the unreleased position.

Figure 9:
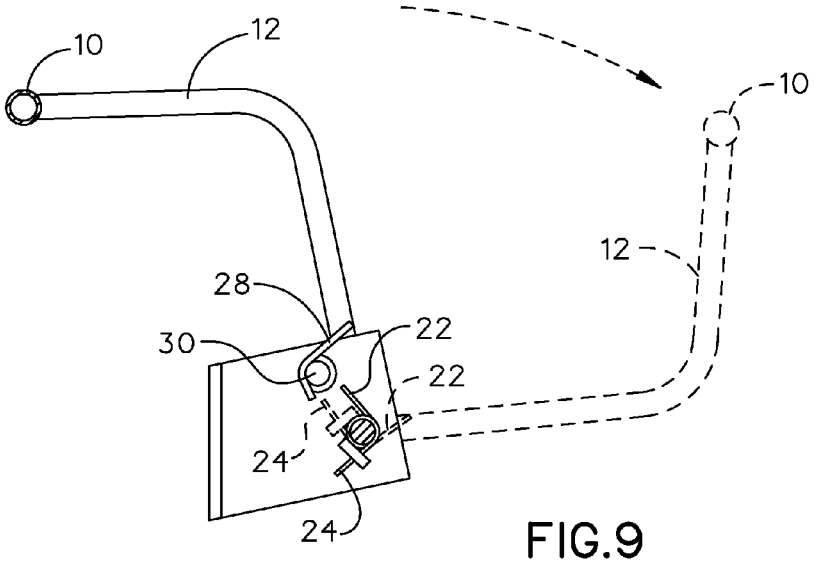
FIG. 9 is a section detail view of an exemplary embodiment of the present invention, taken along line 9-9 in FIG. 8, illustrating the movement in the unlocked position.

In the unlocked position, the upper tab 28 disengages from the upper moment arm 22, as illustrated in FIG. 8, so that no rotation force and/or torque may be transmitted to the biasing mechanism 20, as illustrated in FIG. 9, so that the biasing mechanism 20 provides no resistance when rotating the lock bar arms 12 to the released position. As such, the biasing mechanism 20 and its biasing effects may be bypassed so as to permit trash to be deposited in the interior of the trash bin 44 in the unlocked position, with the lock bar arms 12 resting in the released position.

In certain embodiments, the biasing mechanism 20 may be selected so that the pivot bar 14 may be difficult to rotate without the force that may be exerted by the collection truck and/or the self weight of the pivot bar 14 when the trash bin 44 is rotated in the inverted position by the collection truck. For example, the spring constant of the biasing mechanism 20 may be suitable to manually rotate the pivot rod 14.

A method of using the present invention may include the following. The automatic locking apparatus 100 disclosed above may be provided. A user may load the trash bin 44 by unlocking the padlock 42 and removing the shackle. Then the user may rotate the pivot rod 30 from the locked position to the unlocked position, disengaging the upper moment arm 22 and the upper tab 28, so as to bypass the biasing mechanism 20. Then the user may rotate the pivot bar 14, the pair of lock bar arms 12 and the lock bar 10 from the unreleased position to the released position. Next the user may pivot at least one lid 46 from the closed position to the open position to deposit the trash into the trash bin 44. Next the user may rotate the at least one lid 46 to the closed position, rotate the pivot bar 14 to the unreleased position, and the rotate the pivot rod 30 to the locked position so as to re-engaging the upper moment arm 22 and the upper tab 28. The user then may extend the padlock 42 shackle through the aligned holes in the first padlock flange 40 and the second padlock flange 38, and then lock the padlock 42. When the trash collection truck inverts the trash bin 44, with the automatic locking apparatus 100 in the locked position, the pair of lock bar arms 12 may automatically move to the released position so as to enable the at least one trash lid 46 to rotate to the open position so that the trash bin 44 contents dump into a suitable receptacle of the trash collection truck. In rotating to the released position, the lower tab 26 transmits rotational force and/or to the biasing mechanism 20 so as to bias the pivot bar 14 to the unreleased position. When the trash collection truck un-inverts the trash bin 44, the biasing of the biasing mechanism 20 urges the pivot bar 14 to rotate the pair of lock bar arms 12 to the unreleased position.

It should be understood, of course, that the foregoing relates to exemplary embodiments of the invention and that modifications may be made without departing from the spirit and scope of the invention as set forth in the following claims.

What is claimed is:

1. An apparatus for automatically restraining at least one lid of a trash bin comprising:

a frame comprising a biasing side and a lock side, wherein the frame is coupled to a wall of the trash bin;

a pivot bar supported by the frame for rotating between an unreleased position and a released position, wherein the pivot bar is cantilevered to at least one lock bar assembly for restraining the at least one lid of the trash bin from moving from a closed position to an open position, wherein the pivot bar protrudes through the biasing side;

a lower tab joined to the pivot bar near the biasing side;

an upper tab joined to a pivot rod;

the pivot rod journaled through the frame for rotating between a locked position and an unlocked position, wherein the pivot rod protrudes through the biasing side terminating in the upper tab, and the pivot rod protrudes through the lock side terminating in a locking means; and a biasing mechanism disposed about the pivot bar between the lower tab and the biasing side, wherein the biasing mechanism terminates in a first moment arm and an opposing second moment arm, wherein the first moment arm is engaged by the lower tab, and wherein the second moment arm engages the upper tab, whereby transmitting torque to and from the biasing mechanism from and to the pivot bar.

2. The apparatus of claim 1, wherein the second moment arm is disengaged with the upper tab in the unlocked position.

3. The apparatus of claim 1, further including a first padlock flange joined to the lock side, and further including a second padlock flange joined to the pivot rod so as to be operatively associated with the first padlock flange.

4. The apparatus of claim 3, wherein the first padlock flange and the second padlock flange each define a lock hole disposed to be mutually aligned when the pivot rod is in the locked position.

5. The apparatus of claim 1, wherein the pivot bar is pivotably supported by the frame for rotating to and from the released position from and to the unreleased position.

6. The apparatus of claim 1, wherein the biasing mechanism comprises a torsion spring.

7. An apparatus for automatically restraining at least one lid of a trash bin comprising:

a frame comprising a biasing side and a lock side, wherein the frame is coupled to a wall of the trash bin, wherein the lock side provides a first padlock flange;

a pivot bar journaled through the frame for rotating between an unreleased position and a released position, wherein the pivot bar is cantilevered to at least one lock bar assembly for restraining the at least one lid of the trash bin from moving from a closed position to an open position, wherein the pivot bar protrudes through the biasing side terminating near a provided lower tab;

a pivot rod journaled through the frame for rotating between a locked position and an unlocked position, wherein the pivot rod protrudes through the biasing side terminating in an upper tab, and the pivot rod protrudes through the lock side terminating in a second padlock flange operatively associated with the first padlock flange; and a biasing mechanism disposed about the pivot bar between the lower tab and the biasing side, wherein the biasing mechanism terminates in a first moment arm and an opposing second moment arm, wherein the first moment arm is engaged by the lower tab, and wherein the second moment arm engages the upper tab, whereby torque is transmitted to and from the biasing mechanism from and to the pivot bar.

8. The apparatus of claim 7, wherein the first padlock flange and the second padlock flange each define a lock hole disposed to be aligned when the pivot rod is in the locked position.

9. The apparatus of claim 7, wherein the frame comprises a housing enclosing at least a portion of moving parts of a locking mechanism, wherein the housing is sandwiched between the biasing side and the lock side.

10. A method for manually bypassing a biasing mechanism an apparatus for automatically restraining a lid of a trash bin comprising:

providing a frame comprising a biasing side and a lock side, wherein the frame is coupled to a wall of the trash bin, wherein the lock side provides a first padlock flange; a pivot bar journaled through the frame for rotating between an unreleased position and a released position, wherein the pivot bar is cantilevered to at least one lock bar assembly for restraining at least one lid of the trash bin from moving from a closed position to an open position, wherein the pivot bar protrudes through the biasing side terminating near a provided lower tab; a pivot rod journaled through the frame for rotating between a locked position and an unlocked position, wherein the pivot rod protrudes through the biasing side terminating in an upper tab, and the pivot rod protrudes through the lock side terminating in a second padlock flange operatively associated with the first padlock flange; and a biasing mechanism disposed about the pivot bar between the lower tab and the biasing side, wherein the biasing mechanism terminates in a first moment arm and an opposing second moment arm, wherein the first moment arm is engaged by the lower tab so as to transmit torque to and from the biasing mechanism, wherein the first padlock flange and the second padlock flange each define a lock hole disposed to be aligned when the pivot rod is in the locked position.; and removing a shackle of a padlock through the aligned holes of the first and second padlock flange;

rotating the pivot rod from the locked position to the unlocked position; and rotating the pivot bar from the unreleased position to the released position.

* * * * *